US006913353B2

(12) United States Patent
Williams

(10) Patent No.: US 6,913,353 B2
(45) Date of Patent: Jul. 5, 2005

(54) INKJET FIXER FLUID APPLICATOR

(75) Inventor: Kenneth R. Williams, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 42 days.

(21) Appl. No.: 10/342,514

(22) Filed: Jan. 15, 2003

(65) Prior Publication Data

US 2004/0135860 A1 Jul. 15, 2004

(51) Int. Cl.[7] ..... B41J 2/01
(52) U.S. Cl. ..... 347/101; 347/103; 347/96
(58) Field of Search ..... 347/101, 103, 347/96, 100; 399/341, 101; 400/1; 101/1

(56) References Cited

U.S. PATENT DOCUMENTS 5,252,989 A * 10/1993 Kawakami et al. ..... 347/171
5,821,972 A 10/1998 Mey et al.
5,889,544 A 3/1999 Mey et al.
5,937,258 A * 8/1999 Acquaviva et al. ..... 399/341
6,011,947 A * 1/2000 Acquaviva et al. ..... 399/341
6,195,526 B1 2/2001 Lee et al.
6,205,312 B1 3/2001 Kim
6,293,668 B1 * 9/2001 Kubby et al. ..... 347/101
6,412,935 B1 7/2002 Doumaux
6,443,568 B1 9/2002 Askeland et al.

* cited by examiner

*Primary Examiner*—Manish Shah

(57) ABSTRACT

In an inkjet fixer fluid applicator, fixer fluid is received onto a first surface. Contact is formed between the first surface and a transfer roller. Fixer fluid is transfer from the first surface to the transfer roller. The fixer fluid is transferred from the transfer roller to an inkjet print medium. The transfer roller and the first surface are separated based on a position of the print medium.

11 Claims, 3 Drawing Sheets

FIG.2
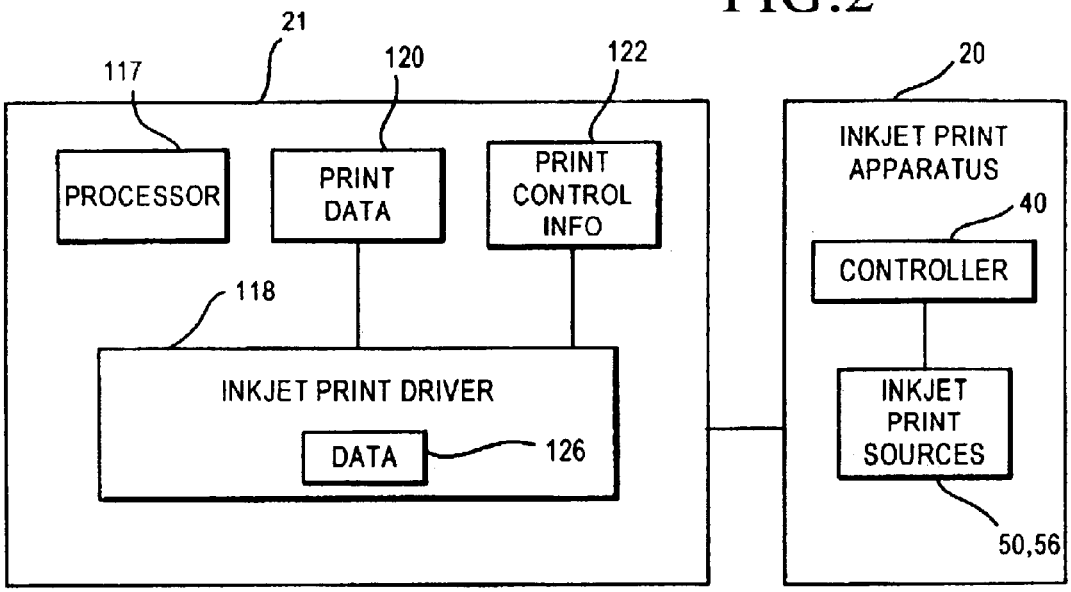
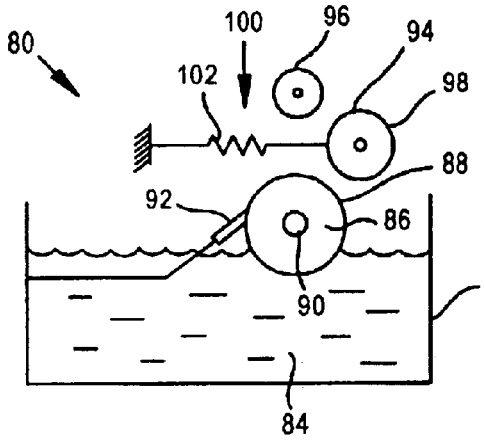
FIG.3
FIG.4
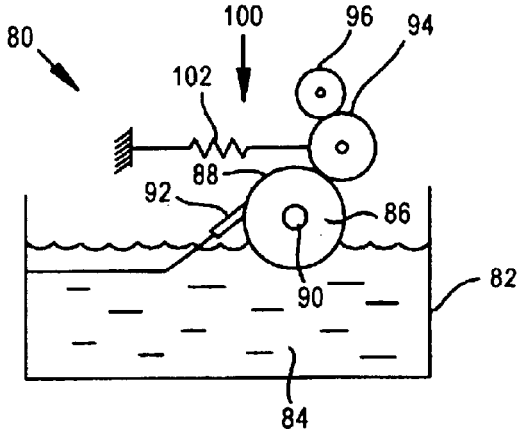
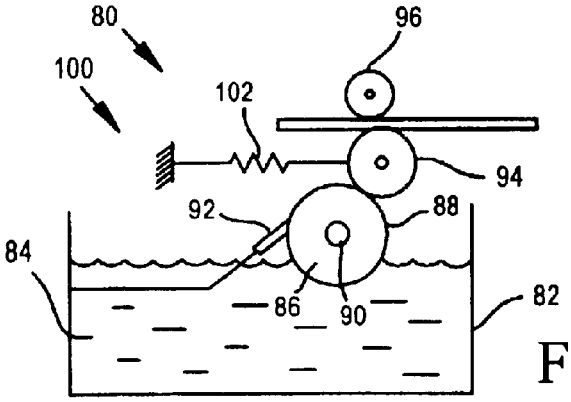
FIG.5

INKJET FIXER FLUID APPLICATOR

BACKGROUND OF THE INVENTION

This invention relates generally to inkjet printing, and more particularly, to fixer fluid application to inkjet print media.

An inkjet printing mechanism is a type of non-impact printing device which forms characters, symbols, graphics or other images by controllably spraying drops of ink using an inkjet printhead. Inkjet printing mechanisms may be employed in a variety of devices, such as printers, plotters, scanners, facsimile machines, copiers, and the like. An inkjet printhead includes chambers which receive ink. Associated with each chamber is a nozzle forming an ejection outlet for the ink. During printing, ink drops are expelled from selective nozzles in a controlled pattern. The ink drops dry on the media sheet shortly after deposition to form a desired image (e.g., text, chart, graphic or other image).

Inks used in inkjet printing mechanisms may be composed of water-soluble organic solvents, surfactants, and colorants in a predominantly aqueous fluid. When a recording is made on plain paper, the deposited colorants retain some mobility, which can manifest as bleed, poor edge acuity, feathering or inferior density/chroma. These features adversely impact text and image quality. It is desirable to reduce these adverse impacts.

SUMMARY OF THE INVENTION

In an inkjet fixer fluid applicator, fixer fluid is received onto a first surface. Contact is formed between the first surface and a transfer roller. Fixer fluid is transferred from the first surface to the transfer roller. The fixer fluid is transferred from the transfer roller to an inkjet print medium. The transfer roller and the first surface are separated.

BRIEF DESCRIPTION OF DRAWINGS

FIG. 2 is a block diagram of an embodiment of a host system in combination with an inkjet printing system;

FIG. 3 is a schematic view of an embodiment of a fixer fluid applicator in an idle state;

FIG. 4 is a schematic view of the fixer fluid applicator embodiment of FIG. 3 during an initial transfer roller cleaning stage;

FIG. 5 is a schematic view of the fixer fluid applicator embodiment of FIG. 3 during an operational state;

DETAILED DESCRIPTION OF A PREFERRED EMBODIMENT

Figure 1:
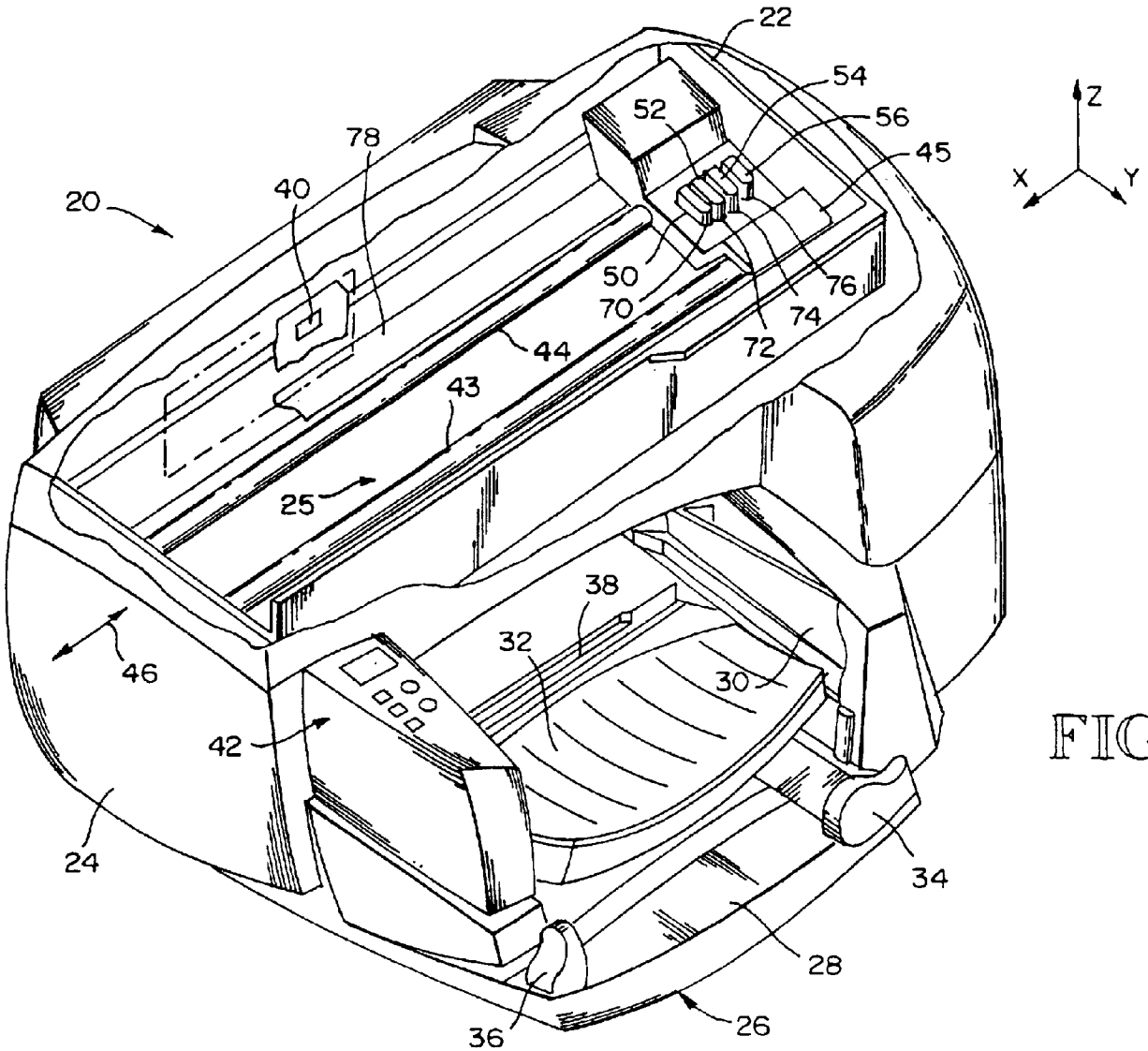
FIG. 1 is a perspective view of an embodiment of an inkjet printing system, here, an inkjet printer.

FIG. 1 illustrates an inkjet printing system, here shown as an inkjet printer 20, constructed in accordance with an embodiment of the present invention. Such system may be used for printing business reports, printing correspondence, and performing desktop publishing, and the like, in an industrial, office, home or other environment. Some of the printing systems that may embody the present invention include portable printing units, copiers, video printers, and facsimile machines, to name a few, as well as various combination devices, such as a combination facsimile/printer. For convenience the concepts of the present invention are illustrated in the environment of an inkjet printer 20.

The inkjet printer 20 includes a frame or chassis 22 surrounded by a housing, casing or enclosure 24, such as of a plastic material. Sheets of print media 23 are fed through a print-zone 25 by a media handling system 26. The print media 23 may be any type of suitable sheet material, supplied in individual sheets or fed from a roll, such as paper, card-stock, transparencies, photographic paper, fabric, mylar, and the like. For convenience, the illustrated embodiment is described using a media sheet of paper as the print medium. The media handling system 26 has a feed tray 28 for storing media sheets before printing. A series of conventional drive rollers driven by a stepper motor and drive gear assembly may be used to move the media sheet from the input supply tray 28, through the print-zone 25, and after printing, onto a pair of extended output drying wing members 30, shown in a retracted or rest position in FIG. 1. The wings 30 momentarily hold a newly printed sheet above any previously printed sheets still drying in an output tray portion 32. The wings 30 then retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller 40, which may be embodied by a microprocessor, that receives instructions from a host device, such as a computer (not shown). The printer controller 40 may also operate in response to user inputs provided through a key pad 42 located on the exterior of the casing 24. A monitor (not shown) coupled to the computer host may be used to display visual information to an operator, such as the printer status or a particular program being run on the host computer.

A carriage guide rod 44 is supported by the chassis 22 to slidably support an off-axis inkjet pen carriage system 45 for travel back and forth across the print-zone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly (not shown) may be coupled to drive an endless belt (not shown), which may be secured in a conventional manner to the carriage 45. Control signals from the printer controller 40 signal the DC motor to incrementally advance the carriage 45 along guide rod 44. To provide carriage positional feedback information to printer controller 40, an encoder strip (not shown) may extend along the length of the print-zone 25 and over the service station area 48, with a conventional optical encoder reader 53 being mounted on the back surface of printhead carriage 45 to read positional information provided by the encoder strip.

Still referring to FIG. 1, while in the print-zone 25, the media sheet 23 receives ink from one or more inkjet cartridges, such as a black ink cartridge 50 and three monochrome color ink cartridges 52, 54 and 56, shown schematically in FIG. 1. The cartridges 50–56 are also often called "pens" by those in the art. The black ink pen 50 may contain a pigment based ink, while the color pens 52–56 each may contain a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include reservoirs for storing a supply of ink. A system where the main ink supply is stored locally within the pen for a replaceable inkjet cartridge system is referred to as an "on-axis" system. A system which stores the main ink supply at a stationary location remote from the print-zone scanning axis is called an "off-axis" system.

Each pen 50–56 includes a printhead 70, 72, 74, 76, respectively. The printheads 70, 72, 74 and 76 each have an orifice plate (not shown) with a plurality of nozzles (not shown) formed therethrough in a manner well known to those skilled in the art. The nozzles of each printhead 70–76 may be formed in at least one, and often two linear arrays along the orifice plate. Thus, the term "linear" as used herein may be interpreted as "nearly linear" or substantially linear, and may include nozzle arrangements slightly offset from one another, for example, in a zigzag arrangement. Each linear array may be aligned in a longitudinal direction perpendicular to the scanning axis 46, with the length of each array determining the maximum image swath for a single pass of the printhead. The illustrated printheads 70–76 may be thermal inkjet printheads, although other types of printheads may be used, such as piezoelectric printheads. The thermal printheads 70–76 may include a plurality of resistors which are associated with the nozzles. Upon energizing a selected resistor, a bubble of gas is formed which ejects a droplet of ink from the nozzle and onto a sheet of paper in the print-zone 25 under the nozzle. The printhead resistors are selectively energized in response to firing command control signals delivered by a multi-conductor strip 78 extending from the controller 40 to the printhead carriage 45.

Referring to FIG. 2, a print job is generated by a host 21 for output to the inkjet print apparatus 20. The host 21 is a print data generating source such as a general purpose microcomputer, a computing device or a microprocessor. The host 21 includes a processor 117 which executes program instructions. The processor executes an inkjet print apparatus driver program 118 which manages print job communication with the inkjet print apparatus 20. The host 21 generates print data 120 and print control information 122 which is input to the print driver 118. For a host computing system, a user typically commands that a file or other unit of data be printed.

Referring to FIGS. 3–5, in an embodiment of an inkjet fixer fluid applicator 80, a dispensing source 82 stores fixer fluid 84. A first roller 86 dispenses the fixer fluid 84. The fixer fluid 84 has components, including acids, salts, and organic counter ions and polyelectrolytes, which reduce ink colorant mobility. In one approach the fixer fluid 84 is applied to a print medium 23 just before the printing of inkjet inks by pens 50–56. The fixer fluid 84 provides a separate reactive layer which reacts with the colorant in the inks improving ink waterfastness. Pre-application of the fixer fluid 84 to a media sheet 23 improves the color saturation, edge acuity and durability of printed inkjet images.

In some embodiments the fixer fluid 84 includes a cationic liquid composition such as a polyallylamine which is underprinted to anionic inkjet dyes to react with the dyes. In another embodiment in which the fixer fluid 84 is used to underprint a polymer dispersed pigment, the fixer fluid 84 includes any of the following for destabilizing the pigment dispersions: polymer latex; silica, alumina, and/or titanium oxide particles; polymer resins; buffer solutions; and inorganic salts. By destabilizing the pigment dispersion the pigment substantially precipitates at the surface of the print medium 23. For water-based inkjet dyes, the fixer fluid 84 contains ligand-complexed metal ions, and in some instances a polymeric viscosity modifier, such as ethylene oxide.

Referring again to FIG. 3, the dispensing roller 86 has a surface 88 which receives the fixer fluid 84. The roller 86 rotates about an axis 90 moving a changing portion of the surface 88 into contact with the fixer fluid 84. Some fixer fluid 84 adheres to the surface 88 based on surface tension and fluid 84 viscosity. Excess fixer fluid is removed from the surface 86 by a wiper blade. 92. The wiper blade 92 is formed by a polyurethane, EPDM or other suitable material.

In operation, a transfer roller 94 contacts the surface 88 receiving fixer fluid 84, as shown in FIG. 4. The transfer roller 94 transfers the fixer fluid to a print medium 23 which is pressed to the transfer roller 94 by a pinch roller 96, as shown in FIG. 5. Thereafter, the print media 23 receives inkjet ink from one or more inkjet pens 50–56 (see FIG. 1). During a print job, multiple print media 23 may be fed over the transfer roller 94 receiving the fixer fluid. Each print medium 23, in turn, then receives inkjet ink. In an alternative embodiment, the fixer fluid 84 is applied just after each print medium 23 receives inkjet ink.

While idle, the transfer roller 94 is positioned out of contact with the surface 88 to minimize the transfer of fixer fluid 84 onto the pinch roller 96. As shown in FIG. 3, a small amount of fixer fluid 84 residue 98 may adhere to the transfer roller 94. Dried residue 98 can get onto a subsequent print medium 23 and decrease image quality. To avoid such a problem, at the start of a transfer operation, the transfer roller 94 contacts the surface 88 without a print medium 23 to receive the fixer fluid. The roller 86 rotates as does the transfer roller 94. As a result, wet fixer fluid 84 is being applied to the transfer roller 94. Solvents in the fixer fluid 84 dissolve the residue 98 during this initial stage. Thereafter, a print medium 23 is introduced and 'underprinted' or 'overprinted' with fixer fluid 84.

In the embodiment illustrated in FIGS. 3–5, an actuator 100 moves the transfer roller 94 into and out of contact with the roller 86 surface 88. During an idle state, the actuator 100 moves the transfer roller 94 away from the surface 88. During operation, the actuator 100 moves the transfer roller 94 into contact with the surface 88. When the transfer roller 94 moves out of contact with the surface 88, it also moves out of contact with the pinch roller 96. Similarly, when the transfer roller 94 moves into contact with the surface 88, the transfer roller also moves into contact with the pinch roller 96. In one embodiment the actuator 100 includes a tension, compression or torsion spring 102 which biases the transfer roller 94 into contact with the surface 88.

Figure 6:
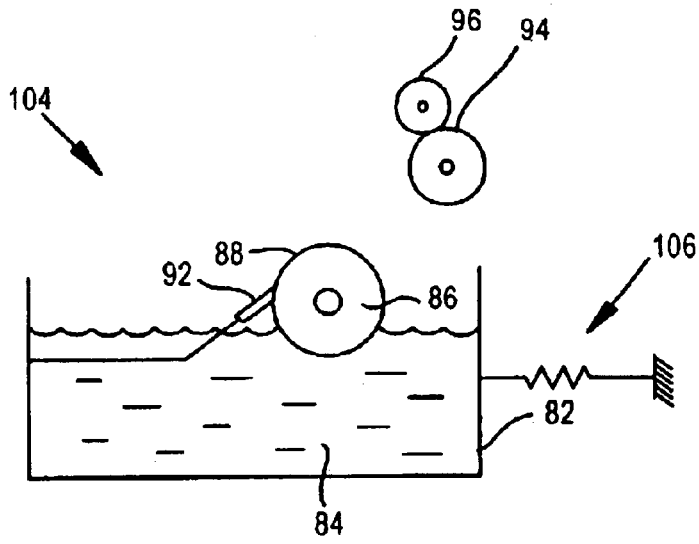
FIG. 6 is a schematic view of another embodiment of a fixer fluid applicator.
Figure 7:
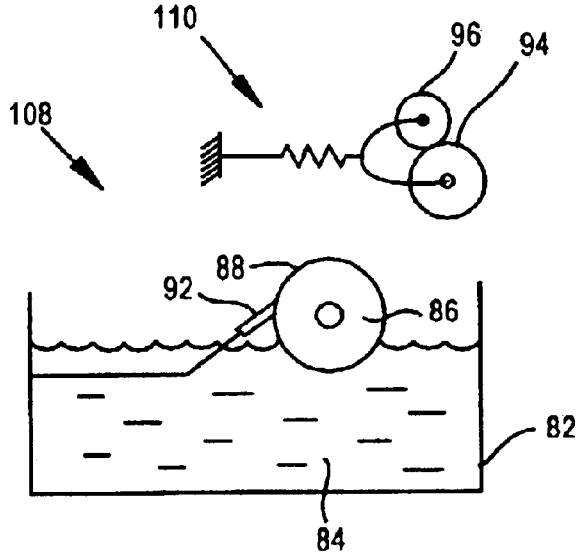
FIG. 7 is a schematic view of still another embodiment of a fixer fluid applicator.
Figure 8:
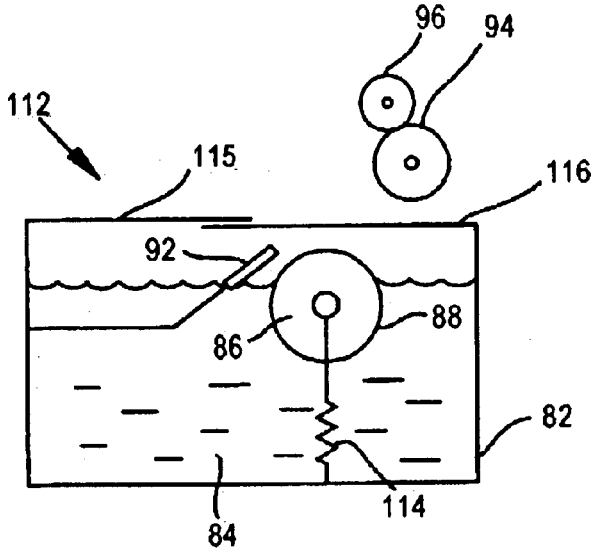
FIG. 8 is a schematic view of yet another embodiment of a fixer fluid applicator.

Referring to FIG. 6, in an alternative embodiment, an applicator 104 includes like parts with like numbers. In this embodiment, the roller 86 is moved, instead of the transfer roller 94. As shown, an actuator 106 moves the dispensing source 82, including the dispensing roller 86 into and out of contact with the transfer roller 94. In still another embodiment, as shown in FIG. 7, an applicator 108 includes like parts with like numbers. In this embodiment, an actuator 110 is coupled to both the pinch roller 96 and the transfer roller 94 moving the pinch roller and transfer roller concurrently. In yet another embodiment, as shown in FIG. 8, an applicator 112 includes like parts with like numbers. In this embodiment an actuator 114 is coupled to the dispensing roller, moving the roller 86 toward or away from the transfer roller 94. In the embodiments of FIGS. 6–8 the pinch roller 96 and transfer roller 94 remain in contact, while the transfer roller 94 and dispensing roller 86 move into and out of contact. In each of the embodiments described there is relative motion between the dispensing surface 88 and the transfer roller 94 to move them into contact during operation, and to move them out of contact while idle.

Referring again to FIG. 8, the applicator 112 is shown to include a fixed cover 115 and a movable cover 116. The covers 115 and 116 may be included in any of the embodiments shown in FIGS. 3–8. The covers 115 and 116 provide a seal which prevents leakage of the fixer fluid 84 from the fixer fluid source 82, such as during shipping or any other movement of printer 20 (shown in FIG. 1). To enable operation of the dispenser source 112, the cover 116 is opened. In the embodiment of FIG. 8, the dispensing roller 86 is moved upward into position to contact the transfer roller 94 during an 'underprinting' or 'overprinting' operation. Alternatively, for dispensers 80, 104, 108 of FIGS. 3, 6 and 7, the position of the dispensing roller 86 relative to the fixer fluid source 82 remains stationary, while the transfer roller 94 is moved, or the source 82 is moved to bring the dispensing roller 86 and transfer roller 94 into contact for an 'underprinting' or 'overprinting' operation. In various embodiments, the dispenser source 82 cover 116 is moved manually by an operator, or automatically by an actuator (not shown) as directed by the controller 40 (shown in FIGS. 1 and 2).

While the above is discussed in terms of preferred and alternative embodiments, the invention is not intended to be so limited. For example, although the dispensing surface 88 is shown and described as being part of a roller 86, in alternative embodiments, the surface 88 may be a web driven by a plurality of rollers. In each embodiment the dispensing surface receives fixer fluid, either directly by extending below a level of fixer fluid 84 in the fixer fluid source 82, or indirectly by receiving fixer fluid 84 from a brush or other source which extends below the fixer fluid 84 level.

What is claimed is:

1. A method for applying fixer fluid to a print medium, the method comprising:

receiving fixer fluid onto a first surface;

forming contact between the first surface and a transfer roller;

transferring fixer fluid from the first surface to the transfer roller;

transferring the fixer fluid from the transfer roller to the print medium; and separating the transfer roller and the first surface based on a position of the print medium.

2. A method according to claim 1, further comprising:

printing inkjet ink onto the print medium prior to transferring the fixer fluid from the transfer roller to the print medium, the fixer fluid enhancing the durability of print on the print medium.

3. A method according to claim 1, further comprising:

printing inkjet ink onto the print medium after transferring the fixer fluid from the transfer roller to the print medium, the fixer fluid enhancing the durability of print being recorded on the print medium.

4. A method according to claim 1, in which a residue of the fixer fluid that dries onto the transfer roller after a first transfer operation is substantially dissolved during a start-up routine prior to a later transfer operation, wherein during the start-up routine the transfer roller engages the first surface before a print medium is introduced to the transfer roller.

5. A fixer fluid application apparatus, comprising:

means for contacting with a transfer roller a first surface having fixer fluid;

means for transferring fixer fluid from the first surface to the transfer roller;

means for transferring the fixer fluid from the transfer roller to a print medium; and means for separating the transfer roller from the first surface based an a position of the print medium.

6. A fixer fluid application apparatus according to claim 5, in combination with means for printing inkjet ink onto the medium, the fixer fluid enhancing ink durability.

7. A fixer fluid application apparatus, comprising:

a first surface which receives fixer fluid; and a transfer roller which receives fixer fluid from the first surface and transfers the fixer fluid onto a print medium, the apparatus having an operational state based on a position of the print medium during which the transfer roller and the first surface are in contact, and having an idle state based on a position of the print medium during which the transfer roller and the first surface are out of contact.

8. A fixer fluid application apparatus according to claim 7, further comprising:

an actuator which establishes contact between the first surface and the transfer roller for the operational state and which breaks contact between the first surface and the transfer roller for the idle state.

9. An inkjet printing system, comprising:

an inkjet pen which ejects ink onto a print medium;

a fixer fluid applicator having a first surface with fixer fluid;

a transfer roller, wherein the applicator has a first state based on a position of the print medium during which the first surface and the transfer roller are in contact, and has a second state based on a position of the print medium during which the first surface and the transfer roller are out of contact; and a pinch roller pressing the print medium to the transfer roller, the transfer roller transferring fixer fluid from the first surface to the print medium during the first state.

10. An inkjet printing system according to claim 9, further comprising:

an actuator which establishes contact between the first surface and the transfer roller during the first state and which breaks contact between the first surface and the transfer roller during the second state.

11. An inkjet printing system according to claim 10, in which the actuator comprises a spring.

* * * * *